United States Patent [19]

Tenner

[11] 4,021,186

[45] May 3, 1977

[54] METHOD AND APPARATUS FOR REDUCING $NO_x$ FROM FURNACES

[75] Inventor: Arthur R. Tenner, Parsippany, N.J.

[73] Assignee: Exxon Research and Engineering Company, Linden, N.J.

[22] Filed: May 15, 1975

[21] Appl. No.: 577,751

Related U.S. Application Data

[63] Continuation of Ser. No. 480,631, June 19, 1974, abandoned, which is a continuation of Ser. No. 304,108, Nov. 1, 1972, abandoned.

[52] U.S. Cl. ..... 431/10; 431/182; 431/352; 60/39.65

[51] Int. Cl.[2] ..... F23M 1/00

[58] Field of Search ..... 431/173, 182, 183, 184, 431/351, 352, 10, 187, 188; 60/39.65, DIG. 11

[56] References Cited

UNITED STATES PATENTS

| | | | |
|---|---|---|---|
| 3,228,451 | 1/1966 | Fraser et al. | 60/DIG. 11 |
| 3,306,333 | 2/1967 | Mock | 158/4 |
| 3,476,494 | 11/1969 | Buchanan et al. | 431/353 |
| 3,593,518 | 7/1971 | Gerrard | 60/39.65 |
| 3,705,492 | 12/1972 | Vickers | 60/39.65 |
| 3,736,747 | 6/1973 | Warren | 60/DIG. 11 |
| 3,754,393 | 8/1973 | Handa | 60/DIG. 11 |
| 3,826,077 | 7/1974 | Quigg et al. | 60/39.65 |

*Primary Examiner*—John J. Camby
*Assistant Examiner*—Larry I. Schwartz
*Attorney, Agent, or Firm*—H. N. Wells; F. Donald Paris

[57] ABSTRACT

$NO_x$ produced by combustion of nitrogen-containing fuels is reduced by a forced draft burner operating with below stoichiometric mixtures of air and fuel in a primary combustion chamber, combustion being completed by controlled injection of secondary air near the outlet of the chamber.

5 Claims, 3 Drawing Figures

METHOD AND APPARATUS FOR REDUCING $NO_x$ FROM FURNACES

This is a continuation, of application Ser. No. 480,631, filed June 19, 1974 now abandoned which is a continuation of Ser. No. 304,108, filed Nov. 1, 1972, now abandoned.

BACKGROUND OF THE INVENTION

Increasing concern with atmospheric pollution has led to the establishment of standards for known polluting materials present in stack gases, including nitrogen oxides. Nitric oxide (NO) and nitrogen dioxide ($NO_2$) are especially important because they react in the presence of sunlight to form a number of complex compounds which are significant contributors to air pollution and the formation of smog. Nitric oxide (NO) is the principal nitrogen oxide formed during the high temperature reaction between air and hydrocarbon fuels. However, at lower temperatures and in the presence of excess air, nitric oxide (NO) may be converted to nitrogen dioxide ($NO_2$). The ratio of the two oxides varies depending upon the number of variables, e.g., sunlight, oxygen, or other oxidizing or reducing agents, both oxides usually being lumped together and termed $NO_x$.

The present invention relates to a method and apparatus for reducing $NO_x$ resulting from combustion of nitrogen containing fuels. $NO_x$ is produced no matter what type of fuel is used. This is true even though a fuel is burned which does not inherently contain nitrogen as one of its components, e.g. natural gas which is essentially pure methane. Combustion products from a nitrogen-free fuel still contain $NO_x$, which has been derived from the molecular nitrogen introduced as air into the combustion process. The $NO_x$ resulting from the nitrogen in the air may be termed "thermal $NO_x$". Many heavier oils and coal which are commonly used for industrial purposes contain nitrogen compounds in varying amounts. These nitrogen compounds also produce $NO_x$ as part of the combustion process in addition to the $NO_x$ from atmospheric nitrogen. Since nitrogen-containing fuels produce more $NO_x$ than nitrogen-free fuels, it is the reduction of nitrogen $NO_x$ resulting from "fuel $NO_x$" which is the principal object of the present invention.

There are many ways which may be employed to reduce $NO_x$. These may be grouped under at least three major categories: (1 ) Control of the fuel nitrogen; (2 ) treatment of stack gases; and (3 ) control of the combustion process by adjusting the key variables, i.e., oxygen, temperature, mixing and residence time. The present invention deals with a novel burner for control of the combustion process within the third category. A general discussion of the control of nitrogen oxide emissions in combustion may be found in a paper presented by William Bartok et al at the International Congress of Chemical Engineering at the Service of Mankind, European Federation of Chemical Engineering, Paris, France, Sept. 2–9, 1972.

Since nitrogen oxides are produced by the reaction of nitrogen with oxygen, one approach which can be taken is to limit the availability of oxygen for such a reaction. This is complicated by the fact that oxygen is required for the combustion of the fuel and generally must be used in excess in order to assure complete combustion. Burning with a limited air supply to create reducing conditions and thus to minimize the production of nitrogen oxides has been utilized in the prior art, particularly to destroy relatively large quantities of nitrogen oxides which had been formed from chemcial processing. Typical of such prior art processes are the following:

British Pat. No. 1,274,637 — Robert D. Reed et al.
U.S. Pat. No. 2,673,141 — Barman
U.S. Pat. No. 3,505,027 — Breitbach et al.
U.S. Pat. No. 3,661,507 — Breitbach et al.

Formation of nitrogen oxides is favored by high temperatures. Thus, much of the prior art effort has been directed to reducing combustion temperatures in order to reduce $NO_x$ formation. This is, of course, directionally undesirable inasmuch as industrial furnaces operate with greater efficiency when high combustion temperatures are used. However, direct cooling techniques, e.g. flue gas recirculation and water injection, are effective methods of limiting combustion temperatures and thereby the $NO_x$ production. A staged combustion technique incorporating indirect cooling of the flue gases has been used for stationary power boilers as disclosed in U.S. Pat. No. 3,048,131 to Hardgrove. It should be noted that in utility boilers excess air is closely controlled in order to maximize the efficiency of the heat transfer process. These high temperatures result in excessive $NO_x$ production but, combustion at below stoichiometric conditions, which inherently occurs at lower temperatures and under semireducing conditions, will limit the $NO_x$ production. If this first combustion step is followed by cooling of the flue gases, combustion may be completed by addition of air while keeping temperature low and limiting $NO_x$ production. This has been accomplished in utility boilers by firing burners at the bottom of the boiler with sub-stoichiometric air to fuel ratios. By the time the flue gases which are produced have reached the upper portion of the boiler, the temperature has been reduced by cooling against the steam generating tubes and air may be introduced to complete the combustion process. A variation of the staged combustion process has been employed by Livingston (U.S. Pat. No. 3,356,075 ) and by Bienstock et al (U.S. Pat. No. 3,382,822 ) in the firing of boilers with coal.

The foregoing art was directed mainly to reducing $NO_x$ production in utility boilers which by their construction lend themselves to the application of staged combustion. Industrial furnaces used in the petroleum industry are not so simply modified. The physical size and shape of such furnaces is determined by the flames produced by the burners used. Modification of existing furnaces to reduce their $NO_x$ production should preferably be done by replacing burners. Newly designed furnaces should preferably incur a minimum of added expense and a minimum loss of efficiency, while operating with substantially lower $NO_x$ production. An improved furnace must also operate to reduce $NO_x$ produced by the high nitrogen content fuels which are often used. The present invention disclosed herein is an improved method and apparatus whereby a reduction of $NO_x$ production from industrial furnaces may be obtained.

SUMMARY OF THE INVENTION

The $NO_x$ produced by the combustion of fuels containing nitrogen compounds is reduced by a improved method of stage combustion. Primary combustion occurs at sub-stoichiometric conditions in a chamber and thereafter burning is completed by the injection of air into flue gases leaving the chamber where primary combustion occurs. No cooling is provided between the primary and secondary stages as is typical of the prior art. While various burners may be adapted to the improved staged combustion method, in its preferred embodiment, the invention adapts a force draft vortex burner to operate under sub-stoichiometric conditions, discharging into a refractory lined primary combustion chamber. At the outlet of the primary combustion chamber, air is injected about the periphery in such a manner that it completely mixes with the flue gases leaving the combustion chamber. Thereafter, the secondary combustion occurs within the furnace fire box, or, alternatively, within the secondary chamber.

The performance of a staged combustion burner according to the invention as described further hereinafter shows a marked decrease in $NO_x$ production when compared to the equivalent burner without the staging of combustion air. This effect is particularly important for fuels which contain nitrogen compounds but is less so with nitrogen-free fuels.

DESCRIPTION OF THE PREFERRED EMBODIMENTS

Figure 1:
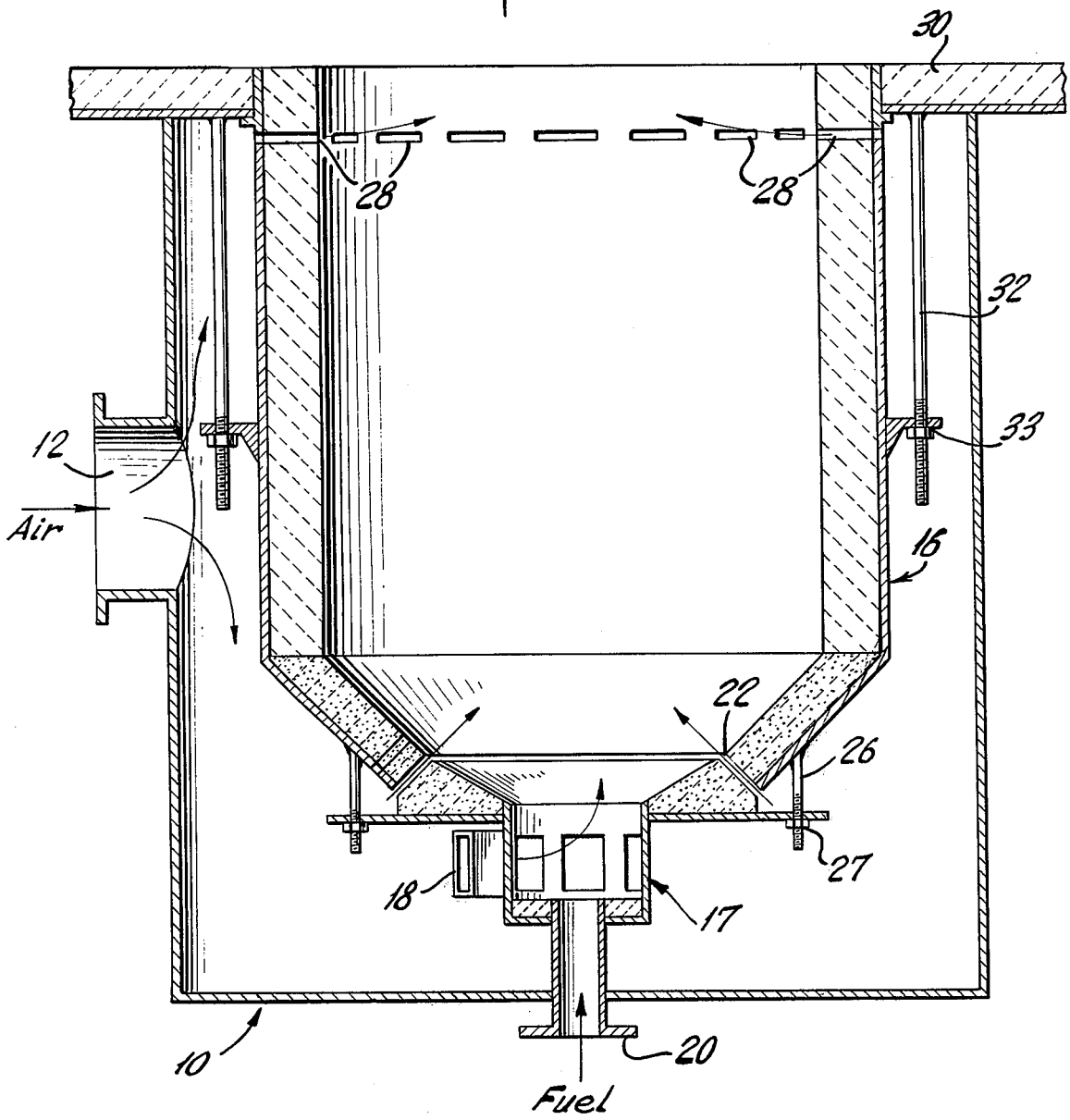
FIG. 1 shows a burner designed according to the present invention.

FIG. 1 illustrates a staged combustion burner, shown generally as 10. Air under positive pressure, typically 3–12 inches of water, enters at 12 and is separated in a predetermined relationship into two streams related to the resistances inherent in the flow passageways. The major portion of the air passes to the primary combustion chamber 16 means of the vortex producing nozzels 18. An intense swirling action is created, which provides a high degree of mixing with the incoming fuel provided through nozzel 20. This vortex burner is disclosed in U.S. Pat. No. 3,476,494. In a typical case, about 65–95% of the air needed for stoichiometric combustion enters the primary combustion chamber 16 through the nozzels 18. The remainder of the air enters through the secondary ports 28 as will be discussed hereinafter. A portion of the primary air may enter through passageways 22 at the circumference of the lower portion of the combustion chamber 16 to provide improved mixing of the fuel and primary air. The amount of air is determined by the width of the gap between the lower portion 17 of the burner relative to the upper portion 16. Adjustment is possible since the lower portion 17 is secured to the upper portion 16 by means of studs 26 and the associated nuts 27. Combustion is initiated as the fuel and air mix at the lower portion of the burner, expanding outwardly along a diverging fillet section by the centrifugal motion of the air. The burning mixture expands to fill the entire refractory lined upper portion 16 of the combustion chamber. The swirling action created provides a substantial amount of recirculation of combustion gases, which has proven highly successful in obtaining efficient combustion in more conventional burners wherein all the air is supplied through the vortex nozzels 18.

The remaining air needed for complete combustion, and some excess, enters through opening 28 which extends completely around the periphery of the upper portion 16 of the combustion chamber near the furnace floor 30, or at the chamber outlet. The amount of air passing into the secondary port 28 may be roughly determined by the width. This is established by means of spacers (not shown) provided within the port 28 which may be varied by positioning the upper portion 16 of the primary combustion chamber relative to the furnace floor 30 by repositioning nut 33 on threaded support rods 32. Fine adjustment is possible by blocking the gap with additional spacers.

Secondary combustion in this embodiment occurs entirely within the furnace firebox under conditions where the heat released by combustion is absorbed continually by the process coil. Alternatively, a secondary combustion chamber may be provided. In either embodiment, both contra to the prior art cited, no cooling is provided between the primary and secondary combustion stages.

Figure 2:
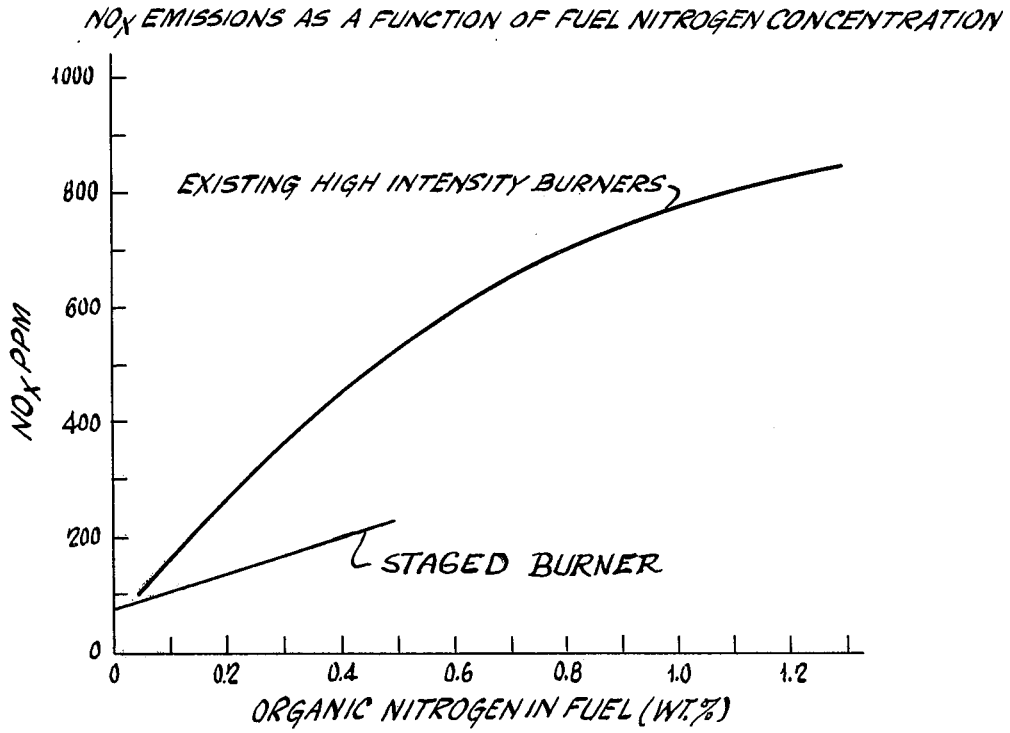
FIG. 2 graphically illustrates the relationship between $NO_x$ production and nitrogen content comparing the staged burner of the present invention with a comparable burner without such staging.

Typical performance of a burner according to the present invention compared with that of a conventional burner of the same type wherein all of the air for combustion is supplied through the lower air ports 18 is illustrated in FIG. 2. It will be seen that a substantial reduction in the amount of $NO_x$ is possible, of the order of 50%. The amount of total $NO_x$ produced is nearly constant over a wide range of nitrogen content. It will be noted that the upper curve corresponding to the conventional burner shows a much steeper increase of total $NO_x$ with the increase in nitrogen content of the fuel. The two curves come together as they approach zero nitrogen content, illustrating that the primary effect of the performance of the staged combustion burner is upon the nitrogen compounds present in the fuel rather than upon the nitrogen from the combustion air. A further reduction of $NO_x$ would be obtained by cooling the combustion products from the primary combustion chamber.

The size and shape of the primary combustion chamber is an important aspect of the design of the burner according to the present invention. Superficial residence time within the primary chamber should be within operable limits characterized as follows: the minimum residence time is set by the breakthrough of unburned hydrocarbon and nitrogen compounds into the furnace firebox; the maximum residence time being only that required for complete combustion, but less than needed for the formation of equilibrium quantities of $NO_x$.

Figure 3:
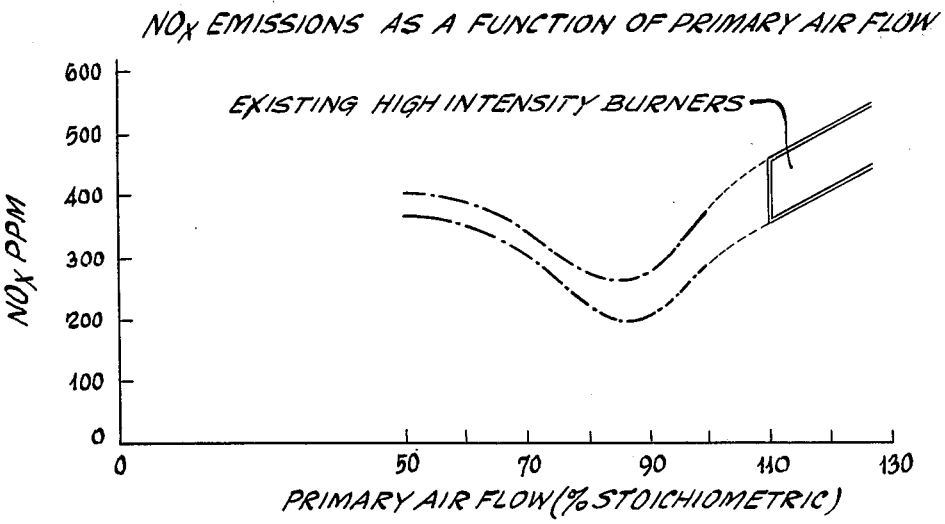
FIG. 3 graphically illustrates the performance of the burner of the invention.

FIG. 3 shows that the performance of the preferred embodiment in reducing $NO_x$ when burning a high nitrogen fuel is determined, other factors held constant, by the amount of the air supplied to the primary chamber. The optimum amount being about 80% of stoichiometric. The increase in $NO_x$ produced when the primary air is reduced below the optimum quantity illustrates the influence of burner design variables on the performance. When the vortex burner of the preferred embodiment is used, the primary combustion chamber should be designed to have at least one cubic foot for each one million btu per hour fired, otherwise insufficient mixing may occur with unburned fuel breaking through to the secondary combustion stage. This volume, however, will vary depending on the effectiveness of the fuel and air mixing system used. The diameter of the primary combustion chamber is determined by the ability to satisfactorily mix secondary air, at the available pressure, with the combustion products leaving the chamber. Within the volume requirements, and limited by the ability to mix secondary air, the length-/diameter ratio should be less than two, if possible.

The foregoing detailed description of the preferred embodiment should not be taken to limit the scope of the invention, which may be practiced in other ways as limited only by the breadth of the claims which follow. For example, other types of burners may be substituted for the vortex burner disclosed herein.

What is claimed is:

1. A burner for reducing $NO_x$ produced from nitrogen containing fuels during combustion thereof and receiving a pressurized main air stream required for complete combustion comprising, in combination:

a. combustion chamber means consisting of a single primary combustion chamber having at one end inlet means and a volume of at least one cubic foot for each million BTU per hour fired for providing a minimum amount of residence time in said chamber comprising a first stage for combustion of the fuel and having a length to diameter ratio less than 2 and wherein combustion takes place at sub-stoichiometric conditions;

b. first means at said one end for introducing through said inlet means a first portion of said pressurized main air stream required for complete combustion to said primary combustion chamber under a positive pressure and in an amount between 65–95% of the stoichiometric amount required to burn said nitrogen containing fuel;

c. second means at said one end for introducing nitrogen containing fuel through said inlet means to said primary combustion chamber within said first portion of said pressurized main air stream introduced by said first means whereby said fuel is mixed with said first portion; and d. means for completing combustion of the products of sub-stoichiometric combustion in a secondary stage of said primary combustion chamber which is directly adjacent said first stage comprising secondary air inlet means for directly introducing a second portion which comprises the remainder of said pressurized main air stream to the products of sub-stoichiometric combustion of said first portion of said pressurized main air stream and said nitrogen containing fuel, said secondary air inlet means located uniformly around the outlet of the said primary combustion chamber for injecting said second portion such that it completely mixes with said products of sub-stoichiometric combustion whereby $NO_x$ production is substantially reduced.

2. The burner of claim 1 wherein said first means comprises a vortex producing means and said second means introduces said fuel within the air vortex formed by said vortex producing means for mixing said fuel with said first portion through intense swirling action of said vortex.

3. The burner of claim 2 including means for introducing to said primary combustion chamber adjacent the air vortex an auxiliary portion of the first portion of said pressurized main air stream near said inlet of said primary combustion chamber.

4. The burner of claim 1 wherein said secondary air inlet means consists of a plurality of opening extending completely around the periphery of said outlet of said primary combustion chamber.

5. A method of combusting nitrogen-containing fuels in a burner having a single combustion zone at low $NO_x$ emissions, consisting of two stages of combustion, comprising the steps of:

a. providing a pressurized air stream to said combustion zone;

b. introducing all of the nitrogen-containing fuel at a first end of a first combustion stage in said combustion zone;

c. introducing a predetermined first portion of said pressurized primary air stream at said first end of said first combustion stage in an amount which is 65–95% of the stoichiometric amount of air required for complete combustion of said fuel;

d. mixing said first portion of air with said fuel in said first combustion stage in said combustion zone for combustion thereof under sub-stoichiometric conditions;

e. providing said single combustion zone with a volume of at least one cubic foot for each million BTU per hour fired, to provide a minimum residence time to allow reaction of said portion of air and said fuel to go to completion and a length to diameter ratio of less than two;

f. transferring the products of sub-stoichiometric combustion of said fuel in said first combustion stage directly to a second combustion stage in the absence of cooling; and g. introducing into said second combustion stage at the outlet of the first combustion stage a second portion of air which comprises the remainder of said pressurized primary air stream, to said products produced by sub-stoichiometric combustion of the fuel in said first combustion stage in an amount sufficient to complete combustion of the fuel.

* * * * *